US006932235B2

(12) United States Patent
Abe et al.

(10) Patent No.: US 6,932,235 B2
(45) Date of Patent: Aug. 23, 2005

(54) DISPENSING SYSTEM INCLUDING A COIN DISPENSER AND A PRINTER

(75) Inventors: Kazuya Abe, Iwatsuki (JP); Masaru Miyaji, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 192 days.

(21) Appl. No.: 10/405,584

(22) Filed: Apr. 1, 2003

(65) Prior Publication Data

US 2003/0217907 A1 Nov. 27, 2003

(30) Foreign Application Priority Data

Apr. 3, 2002 (JP) ..... 2002-101293

(51) Int. Cl.[7] ..... G07F 11/00; G07D 1/00
(52) U.S. Cl. ..... 221/206; 453/19
(58) Field of Search ..... 453/18, 19, 20; 221/206, 92, 93, 123, 124, 207

(56) References Cited

U.S. PATENT DOCUMENTS 6,193,599 B1 2/2001 Kurosawa et al. ..... 453/57
6,340,331 B1 1/2002 Saunders et al. ..... 463/25
2003/0050111 A1 * 3/2003 Saffari ..... 463/25
2003/0100362 A1 * 5/2003 Horniak et al. ..... 463/25

FOREIGN PATENT DOCUMENTS

GB 2.256.519 A * 9/1992 ..... G07F/17/42

* cited by examiner

*Primary Examiner*—Donald P. Walsh
*Assistant Examiner*—Mark J. Beauchaine

(57) ABSTRACT

A dispensing system including a coin hopper for dispensing coins, a printer which prints a value on a ticket, a memory unit for storing a winning amount from a gaming machine, a judgment unit which outputs a dispensing amount to the coin hopper or printer based on the winning amount stored in the memory unit and a threshold value, a controlling unit which selectively asserts a command to either the coin hopper or the printer, a character information converting unit which converts information from a dispensing command into character information for printing on the printer, and a coin hopper driver for operating the coin hopper based on the dispensing amount from the judgment unit.

16 Claims, 5 Drawing Sheets

DISPENSING SYSTEM INCLUDING A COIN DISPENSER AND A PRINTER

This application is based on an application number 2002-101293 filed in Japan, the content of which is hereby incorporated by reference.

BACKGROUND OF THE INVENTION

1. Field of the Invention

This invention is related to a dispensing system that dispenses coins, tokens, or other items of value. Specifically, this invention relates to a gaming machine that dispenses a quantity of one or two different valued denominations after a winning game.

2. Description of Related Art

In a coin gaming machine, a quantity of coins equal to the winning amount is usually dispensed after a winning game. If the winnings are great, the quantity of coins will be large, implying a large weight and volume to transport and store the winnings.

Saunders et al. ("Saunders" U.S. Pat. No. 6,340,331) discloses a networked gaming system that prints a bar-coded ticket for use in accessing a winning balance stored in a central computer, instead of dispensing coins. The gaming machine prints a ticket that can be exchanged for cash only at a cashier station (col. 3 11. 32–39). The exchanging process is time consuming and inconvenient. When the value of the printed ticket is small, or the cashier station is located at a distance from the gaming machine, many game customers abandon their tickets, which is a disadvantage for the customers.

SUMMARY OF THE INVENTION

An object of this invention is to provide a dispensing device that selectively dispenses both large and small value denominations based on a winning balance also called a total dispensing value. The dispensed denominations are different in value compared with each other, such that any winning balance may be represented by a combination of the two denominations. Specifically, the quantity of the small value denominations dispensed is limited and the remainder of the total dispensing value, if any, is dispensed using the large value denomination.

The total value of the predetermined quantity of small denominations dispensed is the quantity of small denominations dispensed multiplied by the small denomination value and is the total dispensing small denomination value. The total value of the predetermined quantity of large denominations dispensed is the quantity of large denominations dispensed multiplied by the large denomination value and is the total dispensing large denomination value. The sum of the total dispensing small denomination value and the total dispensing large denomination value is the total dispensing value.

These denominations may be any "medium of value" including a coin, a medallion, a token, a ball, a banknote, a securities note, a script, a smart card with or without security enhancements, a magnetic card, and a printed ticket with characters representing some locally recognized value. Another object of this invention is to provide a coin dispensing and ticket printing device which can be used on known gaming machines with the benefit that the new coin dispenser capacity can be smaller than in current gaming machines which use only coin dispensers. Even though the capacity of the new coin dispenser can be smaller, the coin dispensing requirements are greatly reduced, so refilling the coin dispenser is required even less frequently, which saves time, power, weight, and space.

The gaming machine includes a controlling device that selectively asserts dispensing commands to coin and printer dispensing units. The controlling device includes a memory unit for storing the winning amount, a threshold setting unit for indicating the value limit for dispensing coins, a character information converting unit, and a judging unit that asserts a dispensing signal to the coin dispensing unit and the printer dispensing unit based on the stored winnings amount and the threshold value.

The coin dispensing unit includes a motor and a motor driver which operates the coin dispenser based on output of the judging unit. The printer dispensing unit includes a printer and a printer driver. The dispensing signal from the controlling device to the printer dispensing unit is first converted by the character information converting unit into printable characters representing the amount of the winnings to be dispensed by the printer. The printer driver receives the converted information from the character information converting unit and prints the large value denomination ticket. In the case where the large value denomination is a medium of value other than the printed ticket, the character conversion is not required.

The threshold value is set so that the portion of the winnings which are less than the threshold are dispensed using the small denomination dispensing unit and the remainder of the winnings, if any, are printed on a ticket. As a result, the customer can receive some coins, but the customer does not carry too many coins because the threshold limit of the amount of coins that are dispensed. The dispensed coins be used in the same or another gaming machine, or for the purchase of inexpensive items.

As the coins are dispensed, a sensor unit examines the coins. The sensor unit contains sensors to detect the type of material, the diameter, and the thickness of the dispensed coins. Some or all of these parameters are compared with expected values in order to determine the authenticity of the dispensed coins.

BRIEF DESCRIPTION OF THE DRAWINGS

The exact nature of this invention will be readily apparent from consideration of the following detailed description in conjunction with the attached drawings which form a part of this disclosure, wherein.

DETAILED DESCRIPTION OF THE PREFERRED EMBODIMENTS

Figure 1:
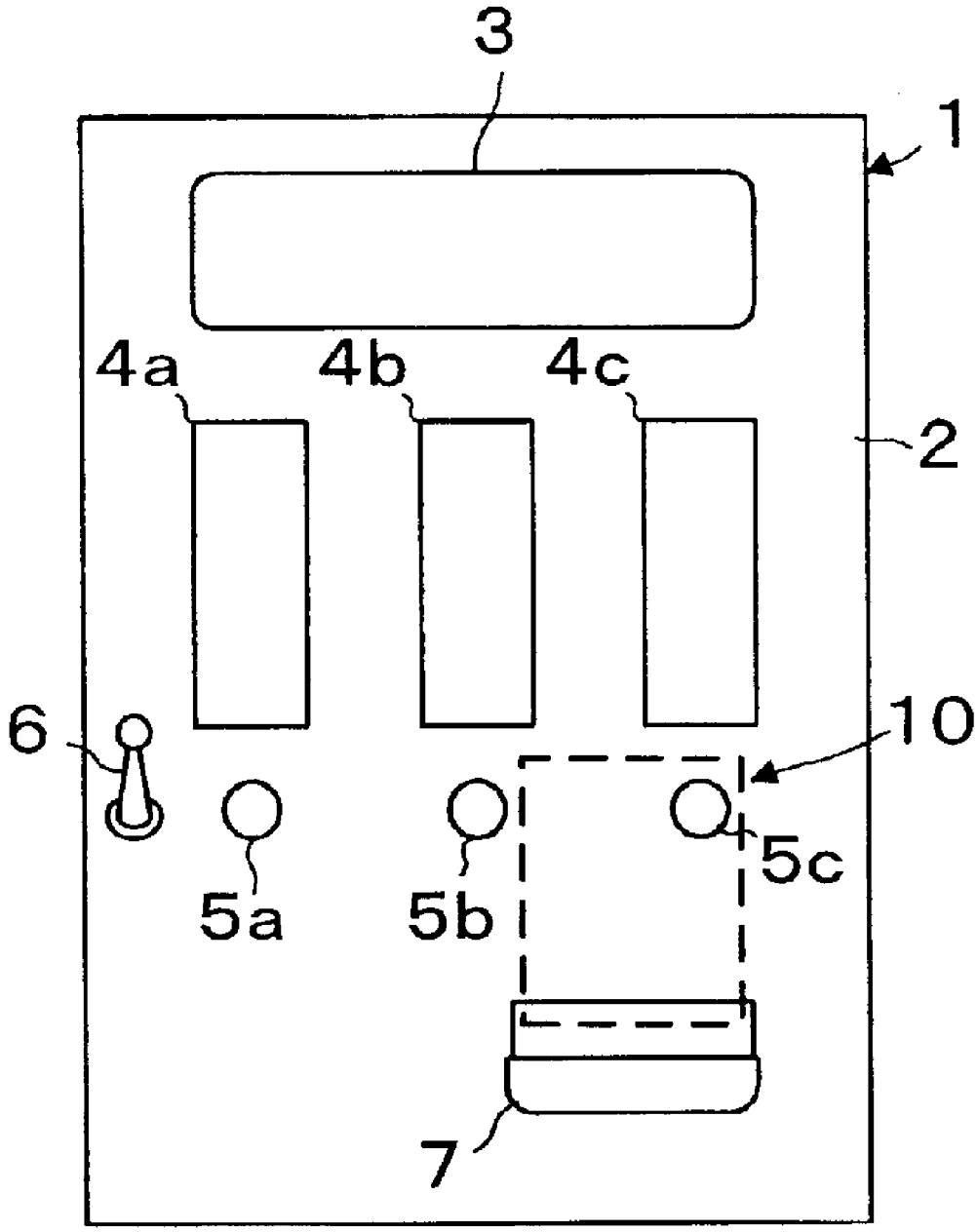
FIG. 1 is a frontal, exterior view of a gaming machine showing the location of the dispensing device in phantom.

In reference to FIG. 1, display 3 is located at the front upper section of body 2, which is a box-like enclosure for a gaming machine 1. Depending on the nature of a particular game, the display and user interface may vary from game to game. In this example of a slot-machine game, three reels 4*a*, 4*b* and 4*c* are located on the middle of the front face of body 2. Stop buttons 5*a*, 5*b* and 5*c* are located below their corresponding reels. The game start lever 6 is located on the side of stopping button 5*a*. The dispensing tray 7 receives the dispensed denominations and is located below stop buttons 5*c* and 5*b*. The denomination dispensing device 10, also called a medium of value dispensing device, is located within body 2 and is shown in phantom view in a location aligned with the dispensing tray 7.

Figure 2:
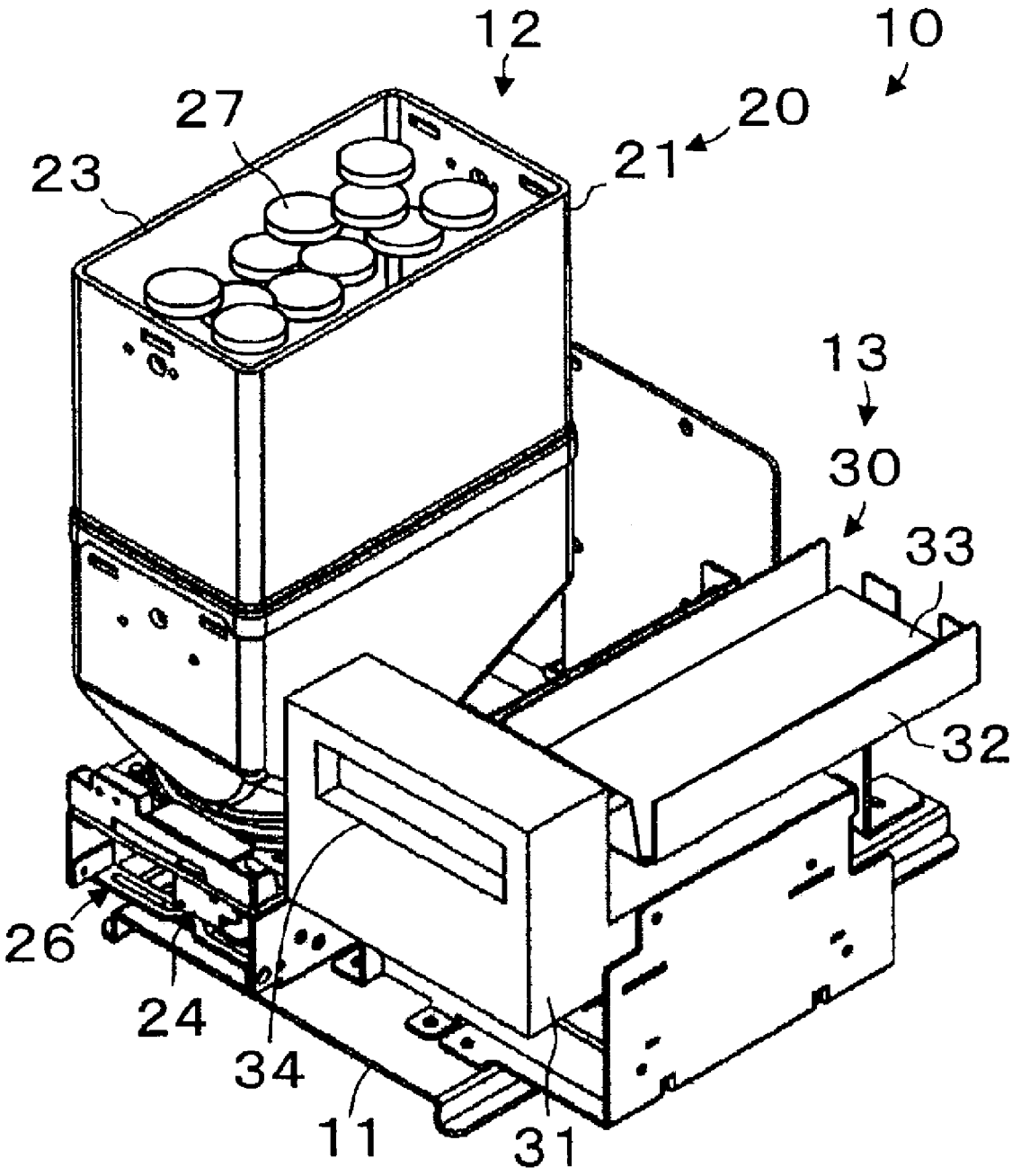
FIG. 2 is a perspective view of the dispensing device showing the small value denomination and the large value denomination dispensing units.

Next, according to FIG. 2, the structure of the denomination dispensing device 10 is explained. The denomination dispensing device 10 includes a first denomination dispensing unit 12 for dispensing denominations of a first value. The denomination dispensing device includes a second denomination dispensing unit 13 for dispensing denominations of a second value. The values of the two denominations are different, with the first denomination being lower or smaller in value than the second denomination. The first denomination dispensing unit is also called a small value dispensing unit. However, in another embodiment, the relative denomination values are reversed so that the second denomination is lower or smaller in value than the first denomination. The denominations used may be physically small, but may be assigned a higher or lower value. In this embodiment, the first denomination is a coin 27, and the first denomination dispensing device 12 is a coin dispensing device 20, also known as coin hopper 21. The first denomination dispensing device 12 is adapted to dispense the particular first denomination and may be changed to another type of dispenser with the same function.

The coin hopper 21 includes a rotating disc (not shown), a motor 22 for operating the rotating disc, a coin bowl 23, a sensor unit 24 and a motor driver 25 for controlling the motor 22. The coin bowl 23 contains a quantity of coins 27 that are dispensed one by one. The sensor unit 24 detects the coins 27 as they are dispensed from the coin dispenser at the output or exit 26. Dispensed coins 27 from the exit 26 pass through a duct (not shown) to arrive in the dispensing tray 7.

As the coins are dispensed, a sensor unit examines the coins. The sensor unit contains sensors to detect the type of coin material, the coin diameter, and the thickness of the dispensed coins. The sensors utilize coils and are economical. The material and diameter sensors are located in close proximity to the first and second thickness sensors. The material and diameter parameters are measured along with the center and rim parameters to increase detection accuracy. Depending on the type of coin, some or all of these parameters may be compared with expected values in order to determine the authenticity of the dispensed coins.

The second denomination is a printed ticket 33, and the second denomination dispensing unit 13 is a printer 30. The second denomination dispensing unit may also be called a large value dispensing unit. The ticket 33 is a single card. Alternatively, the ticket can be changed to a continuous rolled sheet of ordinary or thermal paper that is cut after printing. Printer 30 includes a print head 31, a ticket storing section 32, a ticket transporting mechanism (not shown) and a printer driver 35. The second denomination dispensing device 13 is adapted to dispense the particular second denomination and may be changed to another type of dispenser with the same function.

Ticket 33 is transported one by one at a predetermined speed from the ticket storing section 32 to print head 31 by the ticket transporting. Print head 31 prints the converted information onto the ticket 33, afterwards the ticket is dispensed from exit 34. The printed ticket 33 passes through a duct (not shown) to arrive in the dispensing tray 7. Alternatively, the printed ticket 33 and the dispensed coins may arrive in separate dispensing trays, or into divided portions of the same dispensing tray 7.

According to FIG. 2, the coin hopper 21 and printer 30 are fixed on a sliding base frame 11 that is located within body 2. The sliding base frame slides out of the body 2 for easier access to the dispensing units, to allow refilling of the coin hopper 21, and ticket media or a continuous paper roll.

Figure 3:
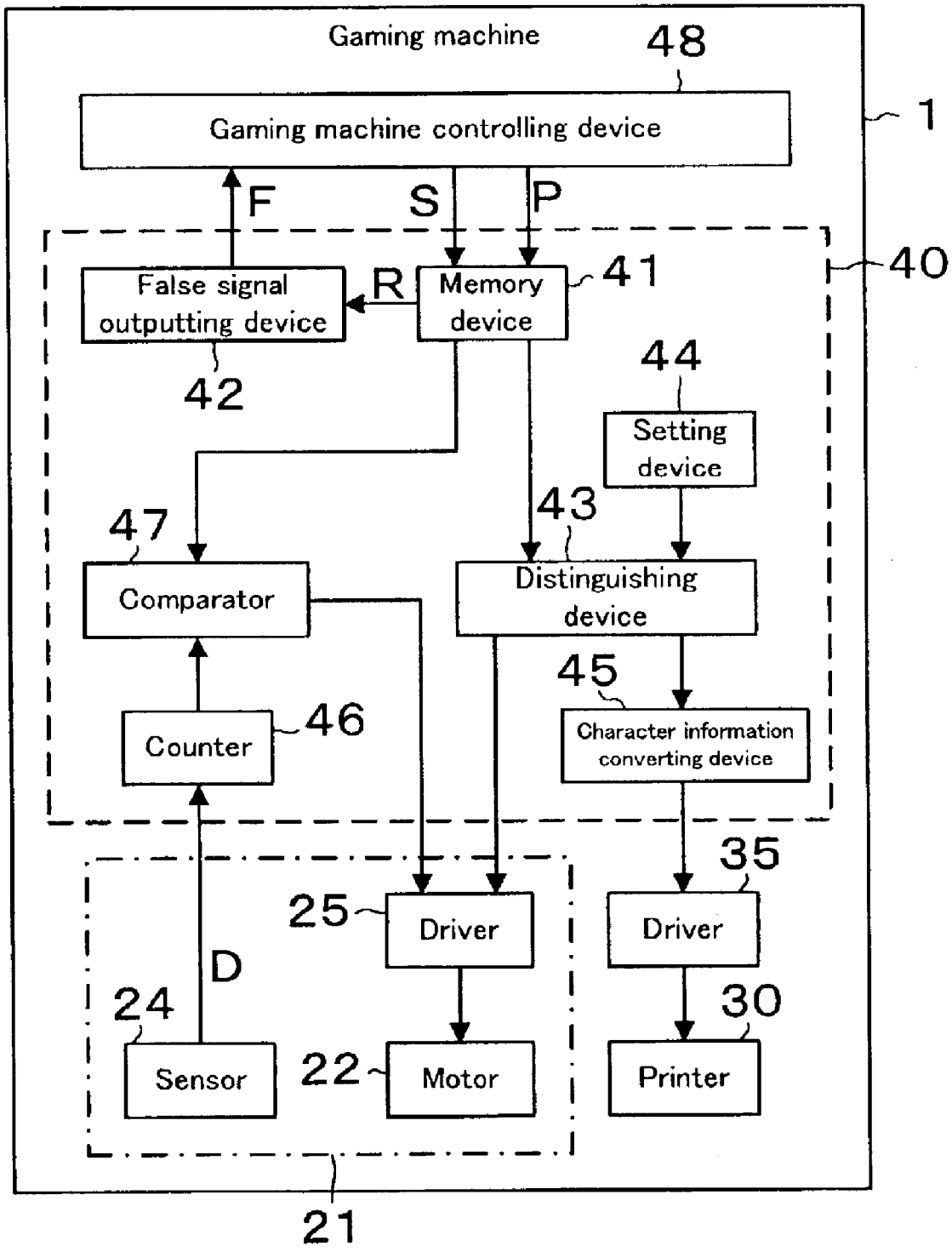
FIG. 3 is a block diagram of the controlling device of the first embodiment.

In reference to FIG. 3, the operation of the dispensing controlling device 40 of the first embodiment is explained. The dispensing controlling device 40 is located along with the coin hopper 21 and includes a memory unit 41 (also called a memory device), a dispense acknowledge unit 42 (also called a false signal outputting device), a judgment unit 43 (also called a distinguishing device), a threshold setting unit 44, a character information converting unit 45, a dispensing counter 46, and a dispensing count comparator 47. The memory unit 41 stores the dispense request signal P (also called a dispensing signal) received from the gaming machine controlling device 48. The memory unit asserts a dispense stored signal R (also called a motor false rotating signal) to the dispense acknowledge unit 42. When the dispense acknowledge unit 42 receives a dispense stored signal R, it asserts a dispense acknowledge signal F (also called a false dispensing signal) to the game machine controlling device 48.

In this embodiment, the dispensing controlling device 40 is fitted to a gaming machine controlling device that dispenses a coin with every rotation step of the coin hopper rotating disc. Therefore, a rotation signal is equivalent to the smallest unit for the dispensed denomination. A false rotation is then a rotation that is requested but has not been executed. It is a request for a rotation of the coin dispenser, once the entire count of rotations is stored in the memory unit 41. The format and timing of the input and output signals may be different than the internal representation of that information. Having separate interface blocks allows the dispensing controlling device 40 to be adaptable to many different gaming machines. The threshold setting unit 44 contains a representation of the selection criterion for judging how much of the winnings may be dispensed by the coin hopper 21 instead of the printer 30.

For example, if the threshold setting unit indicates one dollar and the winning amount stored in the memory unit 41 is less than a dollar, the coin hopper 21 is selected and commanded to dispense the entire winning amount or total dispensing value. If the winning amount is equal to a dollar, the printer 30 is selected and the character information converting device 45 converts the dispensing amount of one dollar from the judging unit 43 into character information for the printer 30. If the winning amount is greater than a dollar, then the portion of the winnings that are an integer multiple of the threshold amount will be dispensed via the printer while any remainder that is less than one threshold amount will be dispensed by the coin dispenser.

The character information printed on the ticket may include alphanumerical characters, a unique identifying mark, or a bar code readable by a scanner, a customer name, gaming machine number, time of day, authentication information, and other information based on local requirements. The character information is printed onto ticket 33 by print head 31.

The dispensing counter 46 counts the detecting signal D that is asserted by the sensor unit 24 as it detects a coin 27 that was dispensed from exit 26 of coin hopper 21. When the coins counted by the dispensing counter 46 equals the requested amount for dispensing, the dispensing count comparator 47 asserts a stopping signal to the motor 22.

The dispensing controlling device 40 can be implemented using a microprocessor where the processing is based on a stored program. Although the dispensing controlling device 40 and the gaming machine controlling device 48 are implemented separately, they may be incorporated together. If the devices are implemented separately, the dispensing controlling device 40 may replace an existing coin hopper on an ordinary gaming machine that uses only coins.

Figure 4:
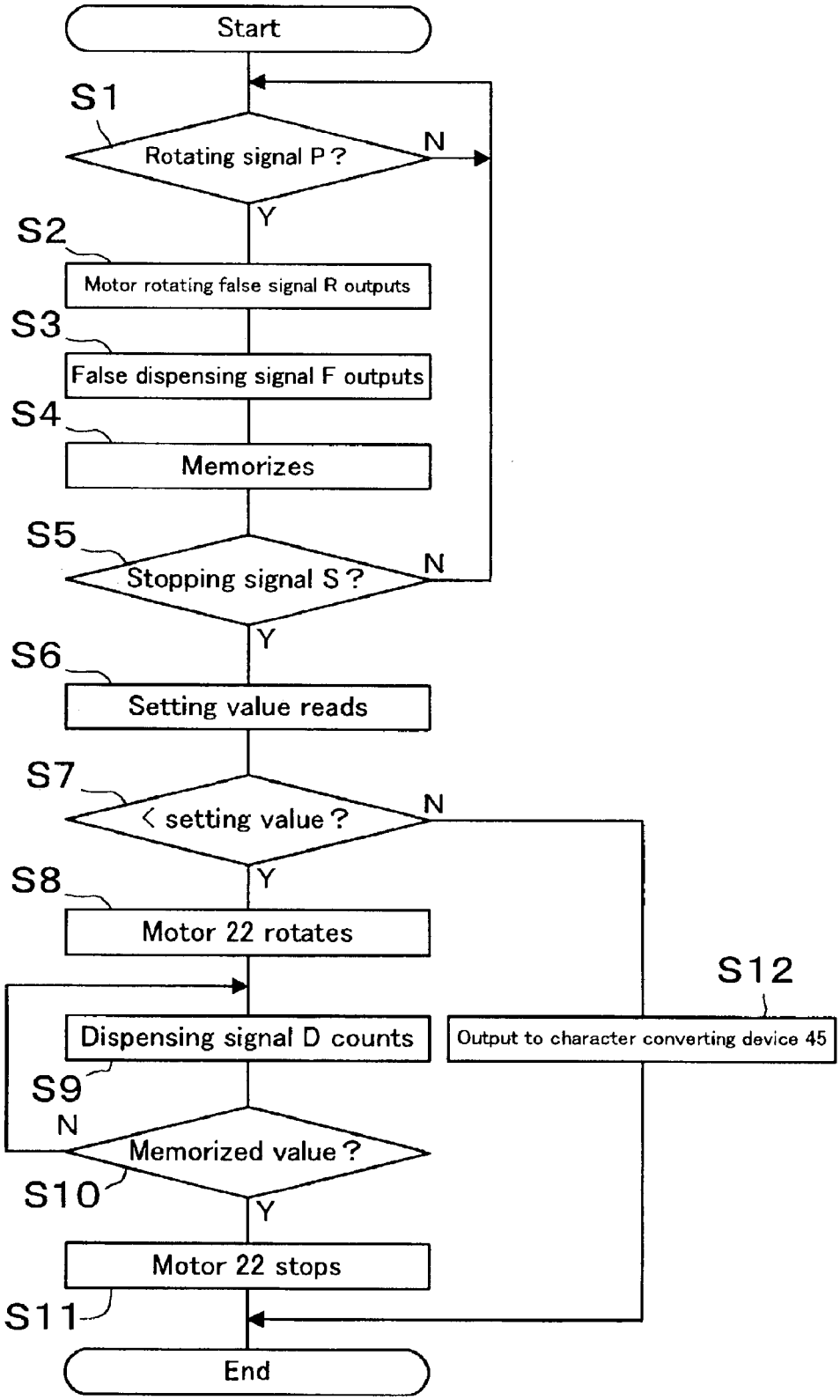
FIG. 4 is a flow chart to illustrate the operation of the dispensing device.

In reference to FIG. 4, the operation of the dispensing device is explained. In this case, two dollars and fifty cents is set up in the threshold setting unit 44 which can be made up of ten coins 27, in this case quarters. First, the winnings amount is stored into the memory unit 41 by the gaming machine controlling device 48 based on a finished game. For example, if the winning amount is two dollars, the gaming machine controlling device asserts eight pulses, one for each quarter, on the dispense request signal P. After eight dispense request signals P have been asserted to the memory unit 41, the gaming machine controlling device 48 asserts a dispense stop signal S to the memory unit 41.

In step S1 "Start", the dispense request signal P (also called the rotating directing signal) is detected. When the dispense request signal P is detected, the program flow goes to step S2.

In step S2, the memory unit 41 asserts a dispense stored signal R (also called a false rotating signal) to the dispense acknowledge unit 42 based on receiving the dispense request signal P.

In step S3, the dispense acknowledge unit 42 asserts a dispense acknowledge signal F to the gaming machine controlling device 48 based on receiving the dispense stored signal R.

In step S4, the dispense stored signal R is stored in the memory unit 41. The gaming machine controlling device 48 counts the dispense acknowledge signals F received from the dispense acknowledge unit 42.

In step S5, if the dispense stop signal S is not detected, the program returns to step S1. If the dispense stop signal S is detected, the program goes to step S6 and the number of dispense requests stored in the memory unit 41 is asserted to the judgment unit 43 (also called the distinguishing device).

In step S6, the threshold setting unit threshold value is read. For example, ten is set up in threshold setting device 44 and it is compared to the stored winnings amount of eight.

In step S7, because the stored value is less than ten, the judgment unit 43 asserts an enabling signal to the motor driver 25 for the dispensing motor 22.

In step S8, the dispensing motor 22 rotates under the control of the motor driver 25 and coins 27 are dispensed one by one. When a coin 27 is dispensed, the sensor unit 24 detects the coin 27 and outputs a detecting signal to the dispensing counter 46.

In step S9, the dispensing counter 46 counts the number of coins dispensed.

In step S10, when the dispensing count equals the dispense requests stored in the memory unit 41, the dispensing count comparator unit 47 asserts a stop signal to motor driver 25.

In step S11, the dispenser motor 22 stops, and the coin dispensing process finishes. Accordingly, eight coins are dispensed into the dispensing tray. FIG. 4 illustrates one example where the winning balance is eight quarters while the threshold setting unit 44 indicates ten quarters.

Alternatively, if the winnings amount stored in the memory unit 41 is ten, while the threshold setting unit 44 indicates ten, the program goes from step S7 to step S12 "End", and the winning amount ten is asserted to the character information converting device 45. The character information converting device 45 converts from ten dispense requests to a character representation of the value of the ten dispense requests, which is two dollars and fifty cents. This character representation is asserted to the printer driver 35 of printer 30. The printer head 31 prints the character information onto ticket 33 and the ticket is dispensed to the dispensing tray 7.

If the memory unit 41 receives ten dispense requests P while the threshold setting unit 44 indicates eight, the judgment unit 43 outputs the value information corresponding to two dollars to the character information converting device 45 and issues the command to dispense two coins to the coin hopper 21. Subsequently, the printer 30 dispenses a ticket 33 indicating a value of two dollars, while the coin hopper 21 dispenses two coins 27.

As further examples, while the threshold setting unit 44 indicates a threshold value of one dollar representing four coins, if the memory unit receives three dispense requests P, the coin hopper dispenses three coins and the printer does not dispense a ticket. In this case, the winnings are less than the threshold value so the entire winnings are dispensed as coins.

Further, while the threshold setting unit 44 indicates a threshold value of one dollar representing four coins, if the memory unit receives eight dispense requests, then the coin hopper does not dispense any coins and the printer dispenses a ticket showing a value of two dollars. In this case, the winnings amount minus the threshold amount is equal to the threshold amount. Since the coin dispenser cannot dispense an amount equal to the threshold amount, the entire winnings are dispensed as a ticket showing the full value of the winnings amount. This is an example of when the winnings amount is an integer multiple of the value of the threshold.

Finally, while the threshold setting unit 44 indicates a threshold value of one dollar representing four coins, if the memory unit receives six dispense requests P, the coin hopper dispenses two coins and the printer dispenses a ticket showing a value of one dollar. The winnings amount minus the threshold amount is two coins which is less than the threshold amount, so two coins are dispensed by the coin hopper.

Figure 5:
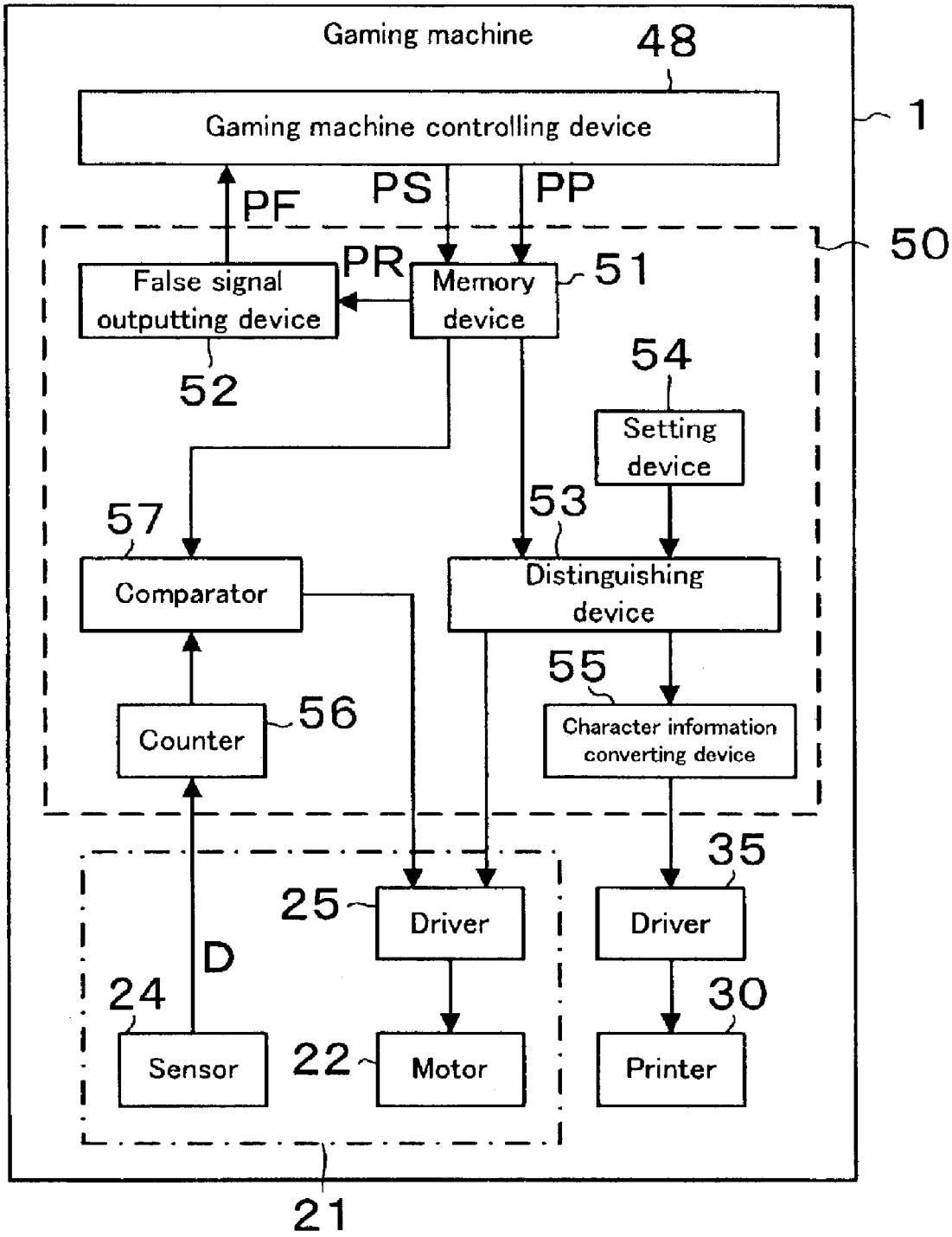
FIG. 5 is a block diagram of a controlling device of the second embodiment.

In reference to FIG. 5, the operation of the dispensing controlling device 50 of the second embodiment is explained. The second embodiment has the same structure to the first embodiment however a printing request signal PP is asserted from the gaming machine controlling device 48 to the dispensing controlling device 50. The dispensing controlling device 50 includes a memory unit 51 (also called a memory device), a dispense acknowledge unit 52 (also called a false signal outputting device), a judgment unit 53 (also called a distinguishing device), a threshold setting unit 54, character information converting unit 55, a dispensing counter 56 and a dispensing count comparator 57. The memory unit 51 stores the printing request signal PP that is outputted by the gaming machine controlling device 48.

The present invention is directed towards providing a dispensing machine for either coin or coinless gaming machines. For the coin gaming machines, the dispensing controlling device 40 provides the capability of dispensing printed receipts as well as some coins. For coinless gaming machines, the dispensing controlling device 50 provides the capability of dispensing a predetermined quantity of coins as well as printed receipts.

In reference to FIG. 5, and analogous to FIG. 3, the printing request signal PP is applied to the memory unit corresponding to a request to print an amount corresponding to one base value. The memory unit 51 outputs the print stored signal PR in response to the print request signal PP. The print acknowledge unit 52 outputs a print acknowledge signal PF in response to a print stored signal PR. The gaming machine controlling device 48 outputs a print stop signal PS when the complete number of requests has been outputted to the dispensing controlling device 50.

The present invention is disclosed in two preferred embodiments but is not limited to the description of the preferred embodiments or specific examples, but is understood to encompass all modifications and alterations within the scope and spirit of the inventive concept.

What is claimed is:

1. A dispensing device, comprising:

a first denomination dispensing unit comprising a coin hopper for selectively dispensing coins;

a second denomination dispensing unit comprising a printer for selectively printing a ticket of a predetermined value;

a memory unit for storing a total dispensing value from a gaming machine;

a judgment unit for asserting dispensing commands to the first or the second denomination dispensing units based on the total dispensing value stored in the memory unit;

a coin hopper driver for selectively operating the coin hopper based on the first denomination dispensing command from the judgment unit; and a character information converting unit for selectively converting the second denomination dispensing command from the judgment unit into character information for printing on the printer.

2. A dispensing device of claim 1, wherein the judging unit includes a threshold setting unit for holding a predetermined threshold value, the judging unit selecting the second denomination dispensing unit when the total dispensing value is greater than or equal to the threshold value, the judging unit selecting the first denomination dispensing unit when the total dispensing value is less than the threshold value.

3. A dispensing system, comprising:

a memory unit for storing a total dispensing value;

a first denomination dispensing unit for dispensing a predetermined first quantity of items each having a first denomination value, the first quantity of items comprising a total first denomination dispensing value;

a second denomination dispensing unit for dispensing a predetermined second quantity of items each having a second denomination value, the second quantity of items comprising a total second denomination dispensing value, wherein the second denomination dispensing unit is a printer, the second denomination being a printed ticket of a predetermined value;

a threshold setting unit for holding a threshold value, the threshold value limiting the first quantity of items;

a judgment unit for comparing the total dispensing value with the threshold value, the judgment unit determining the first quantity of items and the second quantity of items, the judgment unit asserting a dispensing signal to the first denomination dispensing unit dispensing the first quantity of items, the judgment unit asserting a dispensing signal to the second denomination dispensing unit dispensing the second quantity of items; and a character information converting unit providing conversion of a judgment unit dispensing command into character information for printing on the printer, wherein the total first denomination dispensing value added with the total second denomination dispensing value is equal to the total dispensing value, and wherein the total first denomination dispensing value is less than the total second denomination dispensing value.

4. The dispensing system of claim 3, wherein the first denomination dispensing unit is a coin dispenser, the first denomination being a coin.

5. The dispensing system of claim 4, further comprising:

a coin sensor unit for measuring at least one parameter of a dispensed coin, the measurement being compared with at least one expected value to determine the authenticity of a dispensed coin.

6. The dispensing system of claim 5, wherein the coin sensor unit includes a sensor to determine the type of coin material.

7. The dispensing system of claim 5, wherein the coin sensor unit includes a sensor to measure the coin diameter.

8. The dispensing system of claim 5, wherein the coin sensor unit includes at least one sensor to measure the coin thickness.

9. The dispensing system of claim 5, wherein at least one coin sensor is economically implemented using a coil.

10. A method of dispensing denominations of value, comprising the steps of:

storing a total dispensing value;

reading a threshold value;

judging the total dispensing value using the threshold value, a first denomination value, and a second denomination value to determine a first and a second denomination dispensing quantity, wherein the threshold is used to determine a limit for the first denomination dispensing quantity; and dispensing the first and second denomination quantities.

11. The method of claim 10, wherein the first denomination is a coin.

12. The method of claim 10, wherein the second denomination is a printed ticket of a predetermined value.

13. The method of claim 10, further comprising the step of:

verifying the dispensing of the first denomination quantity.

14. The method of claim 12, further comprising the step of:

converting the second denomination quantity into character information for printing.

15. A dispensing device, comprising: p1 a first denomination dispensing unit comprising a coin hopper for selectively dispensing coins;

a second denomination dispensing unit for selectively printing a predetermined value;

a memory unit for storing an inputted total dispensing value;

a judgment unit for asserting dispensing commands to the first and/or the second denomination dispensing units based on the total dispensing value stored in the memory unit;

a coin hopper driver for selectively operating the coin hopper based on the first denomination dispensing command from the judgment unit; and a character information converting unit for selectively converting the second denomination dispensing command from the judgment unit into character information for printing the predetermined value.

16. A dispensing device of claim 15, wherein the judging unit includes a threshold setting unit for holding a predetermined threshold value, the judging unit selecting the second denomination dispensing unit when the total dispensing value is greater than or equal to the threshold value, the judging unit selecting the first denomination dispensing unit when the total dispensing value is less than the threshold value.

* * * * *